US005444465A

United States Patent [19]

Ikeda et al.

[11] Patent Number: 5,444,465

[45] Date of Patent: Aug. 22, 1995

[54] THERMAL TRANSFER RECORDING APPARATUS

[75] Inventors: Kouji Ikeda, Katano; Atsushi Sogami, Sanda; Masanori Yoshikawa; Yoshihisa Fujimori, both of Neyagawa; Nobuyoshi Taguchi, Ikoma, all of Japan

[73] Assignee: Matsushita Electric Industrial Co., Ltd., Kadoma, Japan

[21] Appl. No.: 247,997

[22] Filed: May 24, 1994

[30] Foreign Application Priority Data

May 25, 1993 [JP] Japan ..... 5-122754

[51] Int. Cl.[6] ..... B41J 2/325

[52] U.S. Cl. ..... 347/213; 346/135.1; 347/217

[58] Field of Search ..... 346/76 PH, 135.1; 400/120; 503/227

[56] References Cited

U.S. PATENT DOCUMENTS 5,168,289 12/1992 Katakabe et al. ..... 346/76 PH
5,367,322 11/1994 Sogami et al. ..... 346/76 PH

FOREIGN PATENT DOCUMENTS 62-047717 3/1987 Japan .
62-248669 10/1987 Japan .
63-050198 3/1988 Japan .
64-90772 4/1989 Japan .
01275163 11/1989 Japan .

*Primary Examiner*—Huan Tran
*Attorney, Agent, or Firm*—Cushman, Darby & Cushman

[57] ABSTRACT

A thermal transfer recording apparatus that can arbitrarily perform any one of outputting operations of a sublimable dyestuff image, a thermoplastic ink image, and a mixed picture image which combines a sublimable dyestuff image with a thermoplastic ink image, on a plain recording paper is disclosed. The apparatus employs a dyeable layer which is carried on a substrate sheet usually shared by a plurality of sublimable dyestuff-carrying layers. The dyeable layer is first transferred to a first intermediate transfer medium having a certain mold releasing or parting property. Sublimable dyestuffs are then selectively transferred into the dyeable layer to form a sublimable dyestuff image thereon, which thereafter is transferred to the paper. For obtaining the mixed picture image, the thermoplastic ink image on the second intermediate transfer medium is transferred to the dyeable layer on the first intermediate transfer medium on which the sublimable dyestuff image has already been formed, and thereafter the dyeable layer is transferred to the paper.

19 Claims, 11 Drawing Sheets

THERMAL TRANSFER RECORDING APPARATUS

FIELD OF THE INVENTION AND RELATED ART STATEMENT

1. Field of the Invention

The present invention relates to a recording apparatus which is usable in a printer, a digital copying apparatus, a facsimile device and the like, for recording a desired image or character on a recording paper in response to an inputted electric signal.

2. Description of the Related Art

Recently, as a recording system for use with a printer and the like, a thermal transfer recording system using a thermal head and a ink sheet has been available in the market. Such a system is disclosed in, for example, Japanese Laid-Open Patent Publication No. 82-47,717 and Japanese Laid-Open Patent Publication No. 83-50,198. Apparatuses used with these system are a thermal transfer recording apparatus utilizing thermo-plastic/softening or thermally melting/soluble ink (hereinafter, to be referred to as "thermoplastic ink").

In such a thermal transfer recording apparatus, a plurality of resistive heating elements which are arranged on a front face of a thermal head are caused to selectively generate heat in response to a data signal to be recorded, while the front face of the thermal head is directly pressed against a thermoplastic ink sheet placed on the recording paper. The thermoplastic ink contained in an ink layer of the ink sheet is selectively molten by this heat and is transferred to the recording paper by an adhesive property of the ink. That is, the ink's adhesion force to the recording paper surpasses that to its base or substrate film, for effecting this transferring.

Another thermal transfer recording system as disclosed in Japanese Laid-Open Patent Publication No. 01-275,163 has also been put to practical use. The apparatus disclosed in the publication is a thermal transfer recording apparatus using a sublimable dye. The configuration of the apparatus itself is substantially the same as that using a thermoplastic ink though, this system greatly differs from the thermoplastic ink system. The difference is in the use of an exclusive-use paper specially manufactured by providing a dyeable or dye-receiving layer (hereinafter, to be referred to as dyeable layer) on a thick substrate such as synthetic paper as the recording paper. In such a thermal transfer recording apparatus using the sublimable dye, a plurality of resistive heating elements which are arranged on a front face of a thermal head are caused to selectively generate heat in response to a data signal to be recorded, while the front face of the thermal head is directly pressed against the ink sheet placed on the exclusive-use paper. The sublimable dye contained in the ink sheet is selectively sublimed by this heat and is transferred by thermal diffusion into the dyeable or dye-receiving layer on the surface of the exclusive-use paper for obtaining the desired image or character.

However, with the conventional recording apparatus having the above structure and using the thermoplastic ink, the ink cannot properly adhere to a recording paper which has insufficient superficial smoothness. This in turn results in a poor image quality since the ink often drops from concaved portions of the recording paper. That is, such recording apparatus suffers an disadvantage that it produces an image or character containing a number of voids, i.e., spots where no ink is adhered.

The recording apparatus using the sublimable dye has a disadvantage that it requires a paper of exclusive-use and of special quality which is expensive and is incapable of producing the image or character on an arbitrary recording paper, thereby making the running cost of the apparatus expensive.

There has been a strong need for a recording apparatus capable of producing a fully or multiply colored picture image with a high resolution on any recording paper having a low or high superficial smoothness with the sublimable dye, and producing a character image with the thermoplastic ink at a high speed. Another desired recording apparatus is capable of producing a compound picture image consisting of a fully or multiply colored image of the sublimable dye as well as a character image of the thermoplastic ink, on a single recording paper. It is however not possible to realize such an apparatus with the conventional technology.

OBJECT AND SUMMARY OF THE INVENTION

It is therefore a primary object of the present invention to provide a thermal recording apparatus of simple structure that can produce a high quality character image of the thermoplastic ink with no void on a recording paper of a low superficial smoothness at a high speed.

Another object of the present invention is to provide a thermal recording apparatus that can produce a fully or multiply colored sublimable dye image of a high resolution on a plain paper as well as on an exclusive-use paper.

A further object of the present invention is to provide a thermal recording apparatus that can produce a compound picture image composed of a thermoplastic ink image and a fully or multiply colored sublimable dye image with a high resolution on a single recording paper of any superficial smoothness.

In order to attain the above-mentioned object, the present invention provides a thermal transfer recording apparatus comprising, a first intermediate transfer medium;

a dyeable layer-carrying sheet having a dyeable layer;

a sublimable dyestuff-carrying sheet, having a plurality of sublimable dyestuff layer-carrying sections, each containing a sublimable dyestuff layer;

a dyeable layer-forming means for transferring said dyeable layer on said dyeable layer-carrying sheet, to said first intermediate transfer medium;

a first recording means for forming a sublimable dyestuff image on said dyeable layer on said first intermediate transfer medium, by selectively heating the sublimable dyestuffs contained in said sublimable dyestuff-carrying sheet;

a first transferring means for thermally transferring said dyeable layer formed on said first intermediate transfer medium to a recording paper;

a second intermediate transfer medium;

a thermoplastic ink-carrying sheet having a layer of the thermoplastic ink;

a second recording means for forming a thermoplastic ink image on said second intermediate transfer medium, by selectively heating the thermoplastic ink contained in said thermoplastic ink-carrying sheet;

a second transferring means for thermally transferring said thermoplastic ink image formed on said second intermediate transfer medium to a recording paper; and a third transferring means for thermally transferring said thermoplastic ink image formed on said second intermediate transfer medium to said dyeable layer formed on said first intermediate transfer medium.

In the above-mentioned thermal transfer recording apparatus, each of said first and second intermediate transfer media is preferably a hollow cylindrical layer made of silicone rubber or elastomer and supported on a drum made of metal.

Said silicone rubber or elastomer preferably has a certain mold-releasing or parting property and an adhesivity which may differ from each other for the first and the second intermediate transfer media.

In the above-mentioned thermal transfer recording apparatus, said dyeable layer-forming means may also serve as said first recording means, and the apparatus may further comprise, a sheet transfer means for sequentially transferring said dyeable layer-carrying sheet and said sublimable dyestuff-carrying sheet along a predetermined passage which includes a contact position at which said sheets come into contact with said first intermediate transfer medium and a separating position at which said sheets are bent in a direction to be forcefully separated from said first intermediate transfer medium, and a thermal head for selectively heating said dyeable layer-carrying sheet and said sublimable dyestuff-carrying sheet brought into contact with said first intermediate transfer medium at said contact position so that said dyeable layer selectively adheres to said first intermediate transfer medium, and then said sublimable dyestuff selectively diffuses into said dyeable layer which has been adhered to the first intermediate transfer medium to form a sublimable dyestuff image thereon.

In the above-mentioned thermal transfer recording apparatus, said first transferring means may further comprise, a pressure roller rotatably mounted on a lever which resiliently presses said recording paper against the first intermediate transfer medium through said dyeable layer, and a heating or warmth-keeping means for heating said pressure roller to a target temperature and for keeping this temperature, at which said transferring is sufficiently performed.

Said heating or warmth-keeping means is preferably a halogen lamp combined with a temperature control circuit for performing an on/off control of said halogen lamp in response to a signal from a thermistor disposed in the vicinity of the surface of said pressure roller.

In the above-mentioned thermal transfer recording apparatus, said second recording means may further comprise, a ink sheet transfer means for sequentially transferring said thermoplastic ink-carrying sheet along a predetermined passage which includes a contact position at which said sheet comes into contact with said second intermediate transfer medium and a separating position at which said sheet is bent in a direction to be forcefully separated from said second intermediate transfer medium, and a thermal head for selectively heating said thermoplastic ink-carrying sheet brought into contact with said first intermediate transfer medium at said contact position so that said thermoplastic ink selectively adheres to said second intermediate transfer medium.

In the above-mentioned thermal transfer recording apparatus, said second transferring means may comprise, a pressure roller rotatably mounted on a lever which resiliently presses said recording paper against the second intermediate transfer medium, for effecting said transferring of said thermoplastic ink image to the recording paper.

In the above-mentioned thermal transfer recording apparatus, said first recording means may also serve as said dyeable layer-forming means; and said sublimable dyestuff-carrying sheet, preferably comprises a base or substrate film on which said dyeable layer section and a plurality of sublimable dyestuff layer sections are sequentially painted in combination in the lengthwise direction for every unit.

In the above-mentioned thermal transfer recording apparatus, said third transferring means may further comprise, a heating or warmth-keeping means for heating said second intermediate transfer medium to a target temperature and for keeping this temperature; and a lever which rotatably mounts a drum for supporting said second intermediate transfer medium, for resiliently presses said second intermediate transfer medium against said first intermediate transfer medium through said dyeable layer formed on said first intermediate transfer medium.

Said heating or warmth-keeping means is preferably a halogen lamp combined with a temperature control circuit for performing an on/off control of said halogen lamp in response to a signal from a thermistor disposed in the vicinity of the surface of said second intermediate transfer medium.

The above-mentioned thermal transfer recording apparatus may further comprise, a driving means for driving said first intermediate transfer medium at a variable running speed.

In the above-mentioned thermal transfer recording apparatus, an image forming surface of said second intermediate transfer medium is preferably made of a silicone rubber or elastomer.

In the above-mentioned thermal transfer recording apparatus, said first intermediate transfer medium is preferably provided on a hollow drum-like base or substrate body with a cut-out part; and said second transferring means is preferably configured in a roll-shape, and mounted on said drum-like base or substrate body, so that said roll-shape component of said means can press against said second intermediate transfer medium through said cut-out part.

In the above-mentioned thermal transfer recording apparatus, said first intermediate transfer medium is preferably provided on a drum-like base or substrate body and also serves as said second transferring means.

In the above-mentioned thermal transfer recording apparatus, said first transferring means may comprise, a pressure roller provided with a means for heating and warmth-keeping said pressure roller to a target temperature; and said first transferring means may also serve as said second transferring means.

Said target temperature to which said first transferring means is heated and kept is preferably made switchable.

In the above-mentioned thermal transfer recording apparatus, said second intermediate transfer medium is preferably a layer made of a flexible or elastic material provided on a roll-shape base or substrate body and preferably serves as said first transferring means.

A target temperature to which said second intermediate transfer medium is heated and kept is preferably made switchable.

In accordance with the above-mentioned advantageous structure provided by the present invention, it is possible (1) to form the dyeable layer on the first intermediate transfer medium having the stated mold releasing or parting property; then (2) to form the sublimable dyestuff image thereon, by selectively transferring the sublimable dyestuff contained in the sublimable dyestuff-carrying sheet, in response to an image data signal; and thereafter (3) to record the fully or multiply colored picture image on a plain paper not to mention of a special paper comprising a dyeable layer formed on a substrate, by thermally-transferring the dyeable layer on which the sublimable dyestuff image has been formed by the first transferring means, to the recording paper.

In addition, by virtue of the use of a material having a suitable mold releasing or parting property as well as a suitable flexibility or elasticity for the second intermediate transfer medium, it is possible to form a thermoplastic ink image on the second intermediate transfer medium. The thermoplastic ink image is formed by thermally transferring the thermoplastic ink contained in the thermoplastic ink-carrying sheet in response to the data signal. The thermoplastic ink image is then transferred to the recording paper by pressing the recording paper against the second intermediate transfer medium while the latter is heated, by the second transferring means.

In this manner, it is possible to obtain a picture image of high quality without any void, even in a case of using a recording paper of poor superficial smoothness, because the thermoplastic ink image is caused to imitate or follow after an unevenness of the surface of such recording paper by virtue of the flexibility or elasticity of the second intermediate transfer medium.

In this particular case of configuring the second intermediate transfer medium with a silicone rubber or elastomer, it is possible to surely and stably transfer the thermoplastic ink image formed on the second intermediate transfer medium to the recording paper by virtue of a high mold releasing or parting property which is characteristic to the silicone rubber or elastomer.

The above-mentioned apparatus produces the sublimable dyestuff image by (1) transferring the dyeable layer on the first intermediate transfer medium and then (2) thermally recording the sublimable dyestuff contained in the sublimable dyestuff-carrying sheet in response to the picture data signal. It also produces the thermoplastic ink image on the second intermediate transfer medium by thermally transferring the thermoplastic ink contained in the thermoplastic ink-carrying sheet in response to the picture data signal. Thereafter, the apparatus transfers the thermoplastic ink image formed on the second intermediate transfer medium to the dyeable layer on the first intermediate transfer medium by the third transferring means. And then, it thermally transfers the dyeable layer, on which both the sublimable dyestuff image as well as the thermoplastic ink image are present, to the recording paper by pressing the recording paper against the first intermediate transfer medium by the first transferring means. In this manner, it is possible to record the picture image wherein the thermoplastic ink image as well as the fully colored or multiply colored sublimable dyestuff image are mixed to a single recording paper.

By performing any one of the above-mentioned picture image recording processes, it is possible to arbitrarily select any one of the outputting operation of the sublimable dyestuff image, that of the thermoplastic ink image, and the outputting operation of the picture image wherein the sublimable dyestuff image as well as the thermoplastic ink image are in their mixed state.

Further, by making the running speed of the first intermediate transfer medium switchable, it is possible to always drive the first intermediate transfer medium at its optimum running speed and to realize an apparatus that can always perform a stable picture recording process. The optimum running speed may differ depending upon the steps of forming the dyeable layer on the first intermediate transfer medium, of forming the sublimable dyestuff image on the formed dyeable layer, and of transferring the thermoplastic ink image formed on the second intermediate transfer medium to the dyeable layer formed on the first intermediate transfer medium.

In addition, when the second transferring means is mounted on the drum-like base body for the first intermediate transfer medium, it is possible to make the apparatus structure simpler as compared with that of providing these component separately, and to realize the miniaturization of the apparatus. Further, since the running path of the recording paper can be simplified for the respective picture image recording processes, it is possible to realize an apparatus of high reliability and being free from troubles such as paper clogging.

When the first intermediate transfer medium is employed also as the second transferring means, a separate second transferring means can be dispensed with, and it is possible to realize another simplification of the apparatus, because no provision of a mechanism especially designed for pressing the recording paper against the second intermediate transfer medium is required.

When the first transferring means is employed also as the second transferring means, it is possible to miniaturize the apparatus because the second transferring means can be dispensed with. In addition to this, by configuring the apparatus wherein the switchable heating and warmth-keeping temperature is employed for the first transferring means, it is possible to realize a stable apparatus of wide process latitude. In that case, the first transferring means can be heated to each of the optimum temperatures defined by the processes of thermally transferring the dyeable layer to the recording paper and of transferring the thermoplastic ink image to the recording paper. By keeping the first transferring means to the respective optimum temperatures, it is possible to realize a stable apparatus having a wide process latitude.

Alternatively, when the second intermediate transfer medium provided with the heating and warmth-keeping means is employed also as the first transferring means, the first transferring means can be dispensed with, and it is also possible to simplify the apparatus structure. In that case, the second intermediate transfer medium can be heated to each of the optimum temperatures defined by the processes of thermally transferring the dyeable layer to the recording paper and that of transferring the thermoplastic ink image on the second intermediate transfer medium to the recording paper. By keeping the second intermediate transfer medium 14 to the respective optimum temperatures, it is possible to realize a stable apparatus having a wide process latitude.

While novel features of the invention are set forth on the preceding, the invention, both as to organization and content, can be further understood and appreciated, along with other objects and features thereof, from the following detailed description and examples when taken in conjunction with the attached drawings.

It will be recognized that some or all of the Figures are schematic representations for purposes of illustration and do not necessarily depict the actual relative sizes or locations of the elements shown.

DESCRIPTION OF THE PREFERRED EMBODIMENT

In the following paragraphs, a first embodiment of the present invention will be described with reference to FIG. 1, FIG. 2, FIG. 3, FIG. 4, FIG. 5 and FIG. 6.

Figure 1:
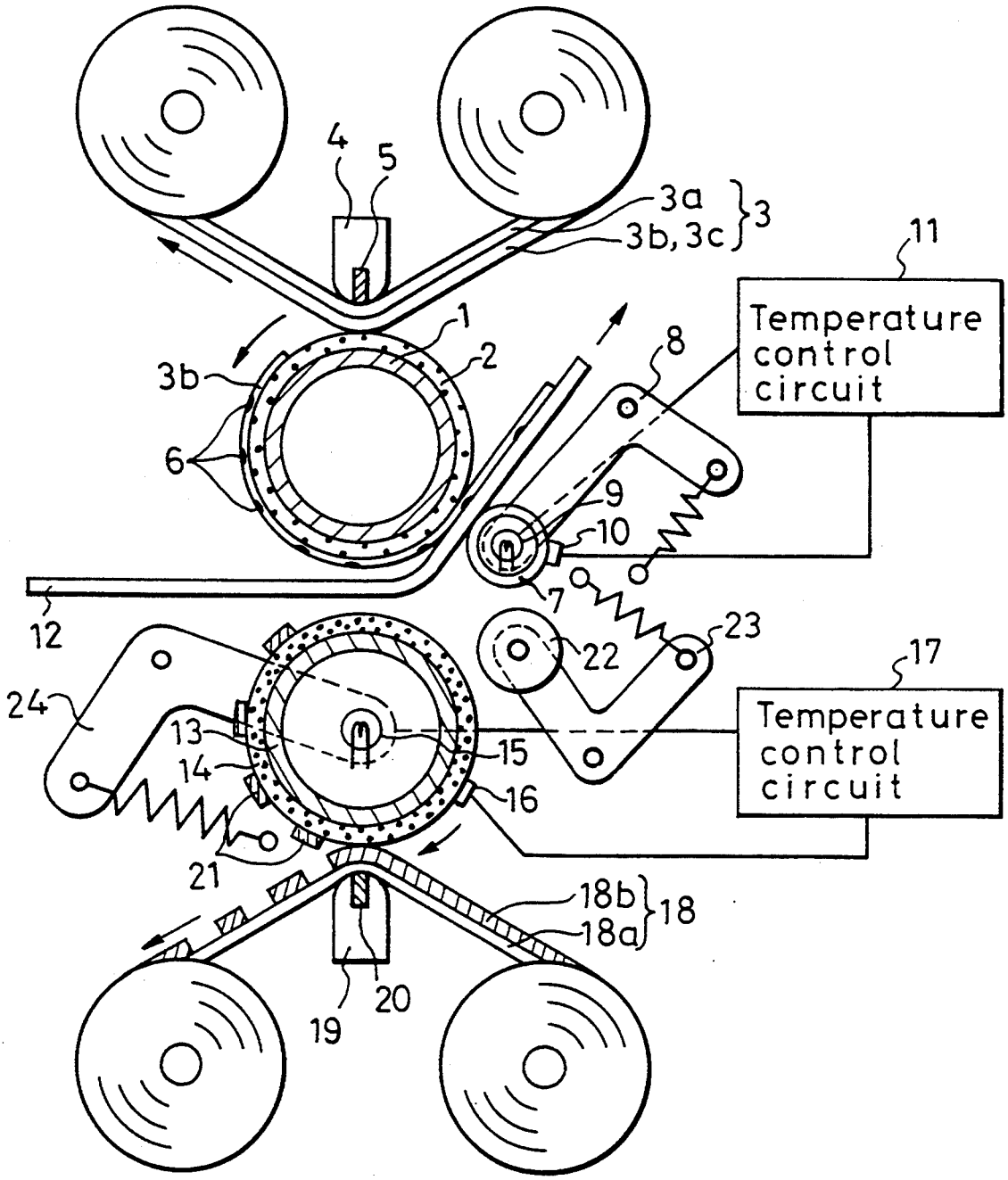
FIG. 1 illustrates a sectional view of a thermal transfer recording apparatus reflecting a first embodiment of the present invention.

In FIG. 1, a first intermediate transfer drum 1 is made of metal and has a circumferential surface coated with a cylindrical layer of a first intermediate transfer medium 2 made of silicone rubber or elastomer (hereinafter, to be referred to simply as "silicone rubber") holding a certain mold releasing or parting property. The first intermediate transfer drum 1 is rotated by a suitable driving means (not shown) at a desired rotational frequency. The driving means is suitably composed of a motor and a transmission mechanism comprising gears, pulleys, belts or the like components. In this embodiment, the rotational frequency of the first intermediate transfer drum 1 is made to be switched between 10 mm/sec. and 50 mm/sec. in its peripheral speed. The switching is effected by changing the voltage to be supplied to the motor. In general, the silicone rubber having a hardness of 20–70 degrees and a thickness of 0.1 mm–2 mm is preferably used for the layer of the first intermediate transfer medium 2. In this embodiment, one available from SHIN'ETSU Chemical Industries Co., Ltd. under a trade designation KE-1925T, having a hardness of 50 degrees and a thickness of 0.4 mm, was employed as a result of a deliberate investigation.

In this embodiment, although the first intermediate transfer medium 2 is made of the silicone rubber holding the suitable mold releasing or parting property, this may alternatively made of another silicone rubber provided with an adhesive material. Further, any other resin materials, for instance, fluorocarbon polymer material, silicone polymer material, polyethylene terephthalate and polylmide resin may be employed, as far as they are holding a suitable mold releasing or mold parting property.

Figure 2:
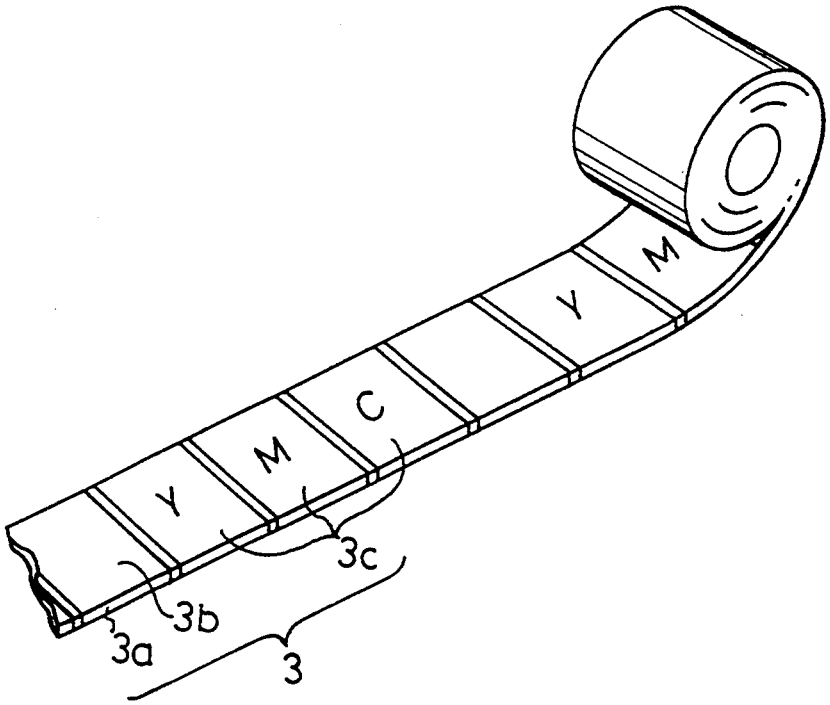
FIG. 2 is a perspective view of a sublimable dye sheet used in the first embodiment.

The reference numeral 3 designates a sublimable ink sheet which is composed by combining a dyeable layer-carrying section with a plurality of sublimable dyestuff layer-carrying sections for every unit thereof. Detail of this sublimable ink sheet is shown in FIG. 2. The sublimable ink sheet 3 is composed of a base or substrate film 3*a* made of polyethylene terephthalate having a thickness of 3–9 μm, on which the dyeable layers 3*b* and the sublimable dyestuff layers 3*c* are painted. The dyeable layers 3*b* and the sublimable dyestuff layers 3*c*, each designated as Y, M and C are formed sequentially and lengthwise on the base or substrate film 3*a*. Each of the sublimable dyestuff layers 3*c* is composed of at least a sublimable dyestuff and a binding agent. As the sublimable dyestuff, any of dispersed dyes, oil colors, basic dyestuffs and the like are used. As the binding agent, a polyester resin, an acryl/styrene resin and the like is used. Further, the dyeable layer 3*b* is required to be provided with a number of characteristic features. First, the dyeable layer 3*b* must have sufficient adhesive forces with both the first intermediate transfer medium 2 and the recording paper 12. It is also important for the dyeable layer 3*b* to have an adhesive force with the dyestuff layer 3*c* which is small enough for permitting easy separation therefrom but its capability of receiving the sublimable dyestuff itself must be high. As a result of investigation on various materials in view of these mutually contradicting requirements, polyvinylbutyral resin is employed in this example. In addition, the rear face of the base or substrate film 3*a* is subjected to a heat-resistant lubricating treatment.

In FIG. 1, the reference numeral 4 designates a first recording means which also serves as a dyeable layer-forming means. The first recording means 4 is composed of a thermal head incorporating a plurality of thermogenic (resistive heating) elements 5 each of which selectively generates a heat in response to an electric signal supplied thereto and is disposed in a row at a tip of the head. The reference numerals 6 designate images of the sublimable dyestuffs recorded on the dyeable layer 3*b* formed on the first intermediate transfer medium 2.

A pressure roller 7 is rotatably supported by a lever 8. A fist transferring means is composed of the pressure roller 7 and the lever 8. The lever 8 is equipped with a spring that resiliently urges the pressure roller 7 on the lever 8 against the first intermediate transfer medium 2 through a recording paper 12 at a desired pressure. The pressure roller 7 is equipped with a heating or warmth-keeping means 9 composed of a halogen lamp. A thermistor 10 is provided in the proximity of the surface of the pressure roller 7 for detecting the surface temperature of the pressure roller 7 and is connected to a temperature control circuit 11. The temperature control circuit 11 adjusts the temperature of the pressure roller 7 to a desired temperature by performing ON/OFF control of the heating or warmth-keeping means 9 in response to the output of the thermistor 10.

A second intermediate transfer drum 13 made of metal is rotatably supported by a lever 24 on its one distal end, and is rotated by a suitable driving means (not shown) at a desired rotational frequency. The lever 24 itself is supported on a stationary part of the apparatus and, by a resiliency of a spring, is configured to urge the second intermediate transfer drum 13 against the first intermediate transfer drum 2 at a desired pressure. On a circumferential surface of the second intermediary transfer drum 13, there is provided a cylindrical layer of a second intermediate transfer medium 14 made of a silicone rubber. Hardness of the silicone rubber for constituting the second intermediate transfer medium 14 is desirably 10–60 degrees and its thickness is desirably 0.1 mm–3 mm. In this embodiment, the silicone rubber having a hardness of 50 degrees and a thickness of 0.4 mm, and being available from SHIN'ETSU Chemical Co., Ltd. under a trade designation KE-951 was employed.

The second intermediate transfer drum 13 is also equipped with a heating or warmth-keeping means 15 composed of a halogen lamp, for heating or keeping the warmth of the image-forming surface of the second intermediate transfer medium 14 to a desired temperature. A thermistor 16 is provided in the proximity of the surface of the second intermediate transfer medium 14 for detecting its surface temperature. The thermistor 16 is connected to a temperature control circuit 17. The temperature control circuit 17 adjusts the temperature of the second intermediate transfer medium 14 to a desired temperature by performing ON/OFF control of the heating or warmth-keeping means 15 in response to the output of the thermistor 16.

A thermoplastic ink sheet 18 is used as an example of the thermoplastic ink-carrying sheet. The thermoplastic ink sheet 18 is configured by painting the thermoplastic ink **18*b* at a film thickness of about 6 $\mu$ on a base or substrate film 18*a* made of a polyethylene terephthalate film having a thickness of 2–9 $\mu$m. As the thermoplastic ink 18*b*, any of the conventionally used ones is employed. The thermoplastic ink 18*b* is typically prepared by dispersing a coloring agent such as carbon black in a binder made of either a natural wax or synthetic wax or a thermoplastic resin, like a polyamide resin or a polyacrylic resin for example. Further, the rear face of the base or substrate film 18*a* is subjected to a heat-resistant lubricating treatment. The second recording means 19 is composed of a thermal head incorporating a plurality of thermogenic elements 20 each of which selectively generates a heat in response to an electric signal supplied thereto and is disposed in a row at a tip of the head. The reference numerals 21 designate images of the thermoplastic ink formed on the second intermediate transfer medium 14**.

A pressure roller 22 is rotatably supported by a lever 23. A second transferring means is composed of the pressing roller 22 and the lever 23. The lever 23 is equipped with a spring that resiliently urges the pressure roller 22 on the lever 23 against the second intermediate transfer medium 14 through a recording paper 12 at a desired pressure.

In this embodiment, a third transferring means is composed of the heating or warmth-keeping means 15 for heating or warmth-keeping the second intermediate transfer medium 14 to a desired temperature, and a lever 24 which is a means equipped with a spring for resiliently pressing the second intermediate transfer medium 14 against the first intermediate transfer medium 2.

Figure 3:
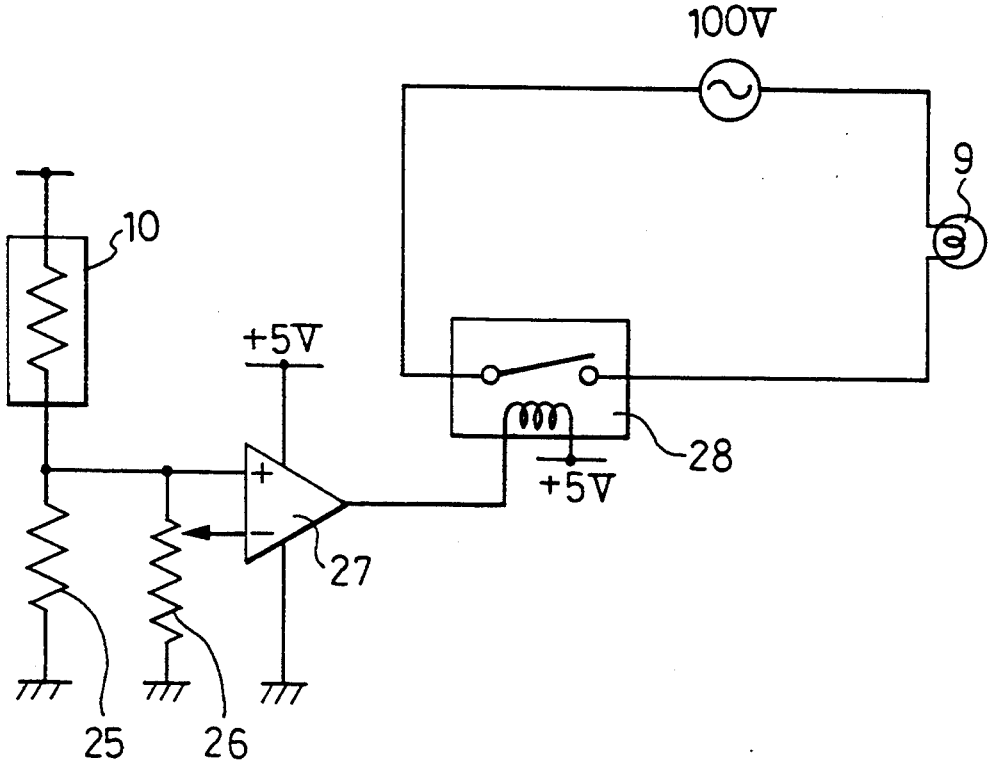
FIG. 3 illustrate a detail of a temperature control circuit in the first embodiment.

Next, the temperature control circuit 11 for adjusting the surface temperature of the pressure roller 7 will be described in detail by referring to FIG. 3. The thermistor 10 is connected to a resister 25 in series. Resistance value of the thermistor 10 varies with the change in the temperature, and a voltage-dividing ratio in a series connection composed of the thermistor 10 and the resistor 25 is changed with the resistance value of the thermistor 10. Resistance value set at a variable resistor 26 corresponds to the value of the temperature set for the surface of the pressure roller 7. A comparator 27 compares a voltage inputted from the thermistor 10 with a voltage inputted from the variable resistor 26. The comparator 27 is designed in a manner that if the voltage inputted from the thermistor 10 is higher than that from the variable resistor 26, the comparator 27 outputs 5 Volt, while if the voltage inputted from the thermistor 10 is lower than that from the variable resistor 26, the comparator 27 outputs 0 Volt. A switch 28 performs an ON/OFF operation in response to the output supplied from the comparator 27. The heating or warmth-keeping means 9 turns on or off in response to the ON/OFF operation by the switch 28.

Further, the temperature control circuit 17 for the second intermediate transfer medium 14 is substantially the same as that of the temperature control circuit 11. Only difference is in the set value of the resistance of the variable resistor 26, namely the temperatures of heating or warmth-keeping differ with each other.

In the following paragraphs, the recording apparatus thus configured will be described in more detail in its operation.

Temperature Controls

First, when a main power source of the apparatus turns on, the halogen lamp of the heating or warmth-keeping means 9 is lit by the temperature control circuit 11. At the time of turning the main power source of the apparatus on, the pressure roller 7 in FIG. 1 is in its low temperature state and the resistance value of the thermistor 10 is high. In this state, the voltage inputted to the comparator 27 in FIG. 3 from the thermistor 10 is lower than the voltage inputted from the variable resistor 26, and 0 volt is outputted from the comparator 27. By this 0 Volt output, a current is flown through the switch 28 to turn on, and the heating or warmth-keeping means 9 is lit.

By this lit state of the heating or warmth-keeping means 9, the temperature of the pressure roller 7 is raised. With the rise in the temperature of the pressure roller 7, the resistance value of the thermistor 10 is lowered and the voltage inputted to the comparator 27 from the thermistor 10 increases. When the voltage from the thermistor 10 becomes higher than that from the variable resistor 26, 5 Volt is outputted from the comparator 27. By this 5 Volt output, no current is flown through the switch 28 to turn off, and the heating or warmth-keeping means 9 is turned off. By repetitions of the turning on and off of the heating or warmth-keeping means 9, the pressing roller 7 can be heated or warmth-kept to the set temperature. Further, by adjusting the resistance value of the variable resistor 26, the set temperature of the pressure roller 7 can arbitrarily be switched.

Although the set temperature of the pressure roller 7 depends upon the material of the first intermediate transfer medium 2, the material of dyeable layer 3*b*, a pressing force of the pressure roller 7 exerted against the first intermediate transfer medium 2 and the like factors, the set temperature is selected to 150° C. in this embodiment.

Similarly to the temperature control circuit 11, the temperature control circuit 17 operates to heat or warmth-keep the second intermediate transfer medium 14 to a desired temperature by repeating the turning on and off of the heating or warmth-keeping means 15. The operation of the temperature control circuit 17 is also substantially the same as that of the temperature control circuit 11. Only difference is in the value of the temperature set for the second intermediate transfer medium 14. Although the set temperature value for the second intermediate transfer medium 14 depends upon the material of the second intermediate transfer medium 14, the material of thermoplastic ink 18*b*, a pressing force of the pressing roller 22 exerted against the second intermediate transfer medium 14 and the like factors, the set temperature is selected to 70° C. in this embodiment.

Image of Sublimable Dyestuff

In the following paragraphs, operations of the recording apparatus for producing the image of the sublimable dyestuff will be described. In FIG. 1, the first recording means 4 is pressed against the first intermediate transfer drum 1 through the sublimable ink sheet 3, and the dyeable layer 3*b* of the sublimable ink sheet 3 is kept at a position where the layer 3*b* comes into contact with the first intermediate transfer medium layer 2. In this state, the first intermediate transfer drum 1 is rotated in the direction of an arrow in this figure, and the sublimable ink sheet 3 is caused to run in the direction of arrow in this figure in a manner that the relative speed of the sublimable ink sheet 3 to the first intermediate transfer medium layer 2 is zero. The peripheral speed of the first intermediate transfer drum 1 is set to 10 mm/sec. At that time, a driving signal is supplied by a control means (not shown) to the first recording means 4, thereby causing the thermogenic (resistive heating) elements 5 provided on the tip of the first recording means 4 to generate heat. With the thus generated heat, an adhesive force between the first intermediate transfer medium 2 and the dyeable layer 3*b* can be made larger than an adhesive force between the dyeable layer 3*b* and the base or substrate film 3*a*. In this manner, the dyeable layer 3*b* of the sublimable ink sheet 3 can be transferred to the first intermediate transfer medium 2. Although the first recording means 4 is caused to generate heat at the time of forming the dyeable layer 3*b* in this embodiment, the generation of the heat is not necessarily required if the adhering force of the dyeable layer 3*b* to the first intermediate transfer medium layer 2 is sufficiently large at room temperature.

Thereafter, a yellow color section Y of the dyestuff layer 3*c* of the sublimable ink sheet 3 is brought to come into a contact with the dyeable layer 3*b* formed on the first intermediate transfer medium 2, and, similarly to the time of forming the dyeable layer 3*b*, the first intermediate transfer medium 2 and the sublimable ink sheet 3 are caused to run concurrently, At that time, a driving signal is supplied by a control means (not shown) to the first recording means 4, thereby causing the thermogenic elements 5 provided on the tip of the first recording means 4 to generate heat. With the thus generated heat, the dyestuff layer 3*c* is selectively heated and the sublimable dye of the dyestuff layer 3*c* is transferred by thermal diffusion into the dyeable layer 3*b* formed on the first intermediate transfer medium 2 in response to the supplied signal. In this manner, an image 6 of the sublimable dye of the yellow color Y is produced on the dyeable layer 3*b*. By performing similar operations with the dyestuff layers 3*c* of a magenta color M and a cyan color C in succession, a plurality of sublimable dye images 6 of Y, M and C colors are produced on the dyeable layer 3*b*.

In this state, by pressing the pressure roller 7 against the first intermediate transfer medium 2 through the recording paper 12, the dyeable layer 3*b* on the first intermediate transfer medium 2, on which the images of the sublimable dyestuffs are formed, can be thermally transferred to the recording paper 12. At that time, a pressing force of the pressure roller 7 exerted against the first intermediate transfer medium 2 is selected to be 2 kgf/cm as a load per width.

With this pressing force, the dyeable layer 3*b* was able to preferably be transferred to a recording paper 12 having a BeKk smoothness of 3 second and a thickness of 150 μm at a peripheral speed of the first intermediate transfer drum 1 of 10 mm/sec. Since the intermediate transfer medium 2 is made of a flexible or elastic silicone rubber, it was possible for the silicone rubber medium to imitate or follow after an unevenness of the surface of the recording paper 12. In this manner, the dyeable layer 3*b* can be made to elaborately imitate or follow after the unevenness of the recording paper 12, thereby producing an image output of preferable fixability.

In this manner, a full- or multi-colored picture image of high production quality was obtained on the recording paper other than the exclusive-use paper, and it was thus possible to realize a reduction of the running cost. In a thermal recording process using the conventional sublimable dyestuffs, no satisfactory picture image had been obtained on the recording paper other than the exclusive-use paper.

Image of Thermoplastic Ink

Figure 4:
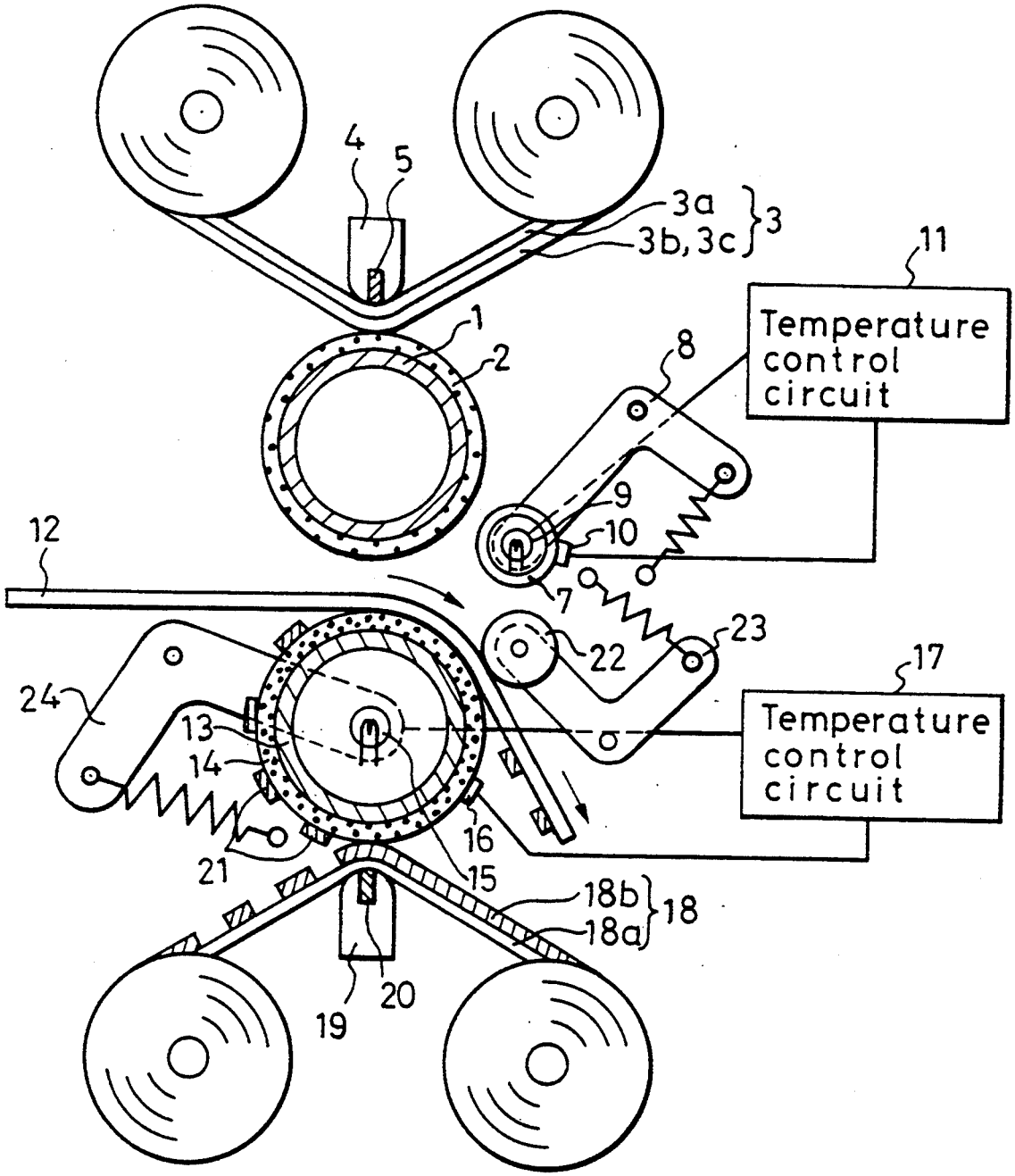
FIG. 4 illustrates a sectional view of a thermal transfer recording apparatus in the first embodiment for indicating an operation of producing an image with a thermoplastic ink.

In the following paragraphs, operations of the apparatus for producing the image of the thermoplastic ink will be described by referring to FIG. 4. In FIG. 4, the second recording means 19 is being pressed against the second intermediate transfer medium 14 through the thermoplastic ink sheet 18. In this state, the second intermediate transfer drum 13 is rotated in the direction of an arrow in this figure, and at the same time, the thermoplastic ink sheet 18 is moved in the direction of an arrow in this figure, in a manner that the relative speed of the thermoplastic ink sheet 18 to the second intermediate transfer medium 14 is zero. The peripheral speed of the second intermediate transfer drum 13 is set to 50 mm/sec. At that time, a driving signal is supplied by a control means (not shown) to the second recording means 19, thereby causing the thermogenic (resistive heating) elements 20 provided on the tip of the second recording means 19 to selectively generate heat. With the heat generated at the thermogenic element 20, the thermoplastic ink 18*b* is brought to its molten state with some adhesive force and thus is adhered to the second intermediate transfer medium 14. The thermoplastic ink sheet 18 is designed in a manner that immediately after the recording has been completed by the second recording means 19, it can be stripped off from the second intermediate transfer medium 14. The peripheral speed of the second intermediate transfer drum 13 is set greater than that of the first intermediate transfer drum 1. This is due to a difference in the transferring speed of the sublimable dyestuff from that of the thermoplastic ink. A heat required for producing the image with the sublimable dyestuff is usually larger than that with the thermoplastic ink. There is also a permissible limit for the generated heat in a thermal head as the recording means. The speed for producing image with the thermoplastic ink can therefore be set greater than that with the sublimable dyestuff. By this speed setting, when the thermoplastic ink sheet 18 is stripped off from the second intermediate transfer medium 14, only a part of the thermoplastic ink 18*b* on the ink sheet 18, that is selectively heated by the second recording means 19, is brought to its low viscosity state. The thermoplastic ink 18*b* in its low viscosity state is transferred to the second intermediate transfer medium layer 14 and produces the thermoplastic ink images 21.

In this embodiment, the thermoplastic ink 18*b* is stripped off in its low viscosity state from the thermoplastic ink sheet 18. This is possible by employing the silicone rubber as the material for the second intermediate transfer medium 14 which has a low adhesion force with the thermoplastic ink 18*b*. Another reason for employing the silicone rubber as the material for the second intermediate transfer medium 14 is to easily perform the transferring operation of the thermoplastic ink images 21 to the recording paper 12. Therefore, in order to preferably produce the thermoplastic ink images 21 on the second intermediate transfer medium 14, the thermoplastic ink 18*b* is stripped off in its low viscosity state.

Next, an operation for transferring the thus produced thermoplastic ink images 21 to the recording paper 12 will be described. After the thermoplastic ink images 21 has been produced on the second intermediate transfer medium 14, the recording paper 12 is forwarded in the direction of an arrow in this figure by a suitable paper transferring means (not shown). The thus forwarded recording paper 12 is pressed against the second intermediate transfer medium 14 by the pressing roller 22, thereby transferring the thermoplastic ink image 21 to the recording paper 12. At that time, the second intermediate transfer medium 14 is heated to a temperature at which the thermoplastic ink image 21 can generate its own adhesivity and kept to this temperature. On the other hand, the second intermediate transfer medium 14 is made of a silicone rubber which has both the excellent mold releasing or parting property as well as the flexibility or elasticity. Therefore, when the recording paper 12 is pressed against the second intermediate transfer medium 14, the thermoplastic ink image 21 on the second intermediate transfer medium 14 can sufficiently imitate or follow after the unevenness of the recording paper 12. It is thus possible to transfer the thermoplastic ink image 21 on the second intermediate transfer medium 14 to the recording paper 12. At that time, the pressing force of the pressing roller 22 exerted against the second intermediate transfer medium 14 is adjusted to 1.5 kgf/cm as a line pressure. With this pressing force and a peripheral speed of the second intermediate transfer medium 14 of 50 mm/sec., substantially the whole amount of the thermoplastic ink image 21 was able to be transferred to the recording paper 12 having a beck smoothness of 3 sec. and a thickness of 150 μm.

In this embodiment, the material quality of the second intermediate transfer medium 14 is very critical. The characteristics required for the second intermediate transfer medium 14 are a suitable adhesion force for holding the thermoplastic ink 18*b*, a suitable mold releasing or parting property required for transferring the ink image 21 to the recording paper 12, and a suitable flexibility or elasticity required for making the thermoplastic ink image 21 to satisfactorily imitate or follow after the unevenness of the recording paper 12. As a result of deliberate investigation based on these requirement, the silicone rubber available from SHIN'ETSU Chemical Ind. Co., Ltd. under the trade designation KE-951 was selected and employed in this embodiment.

In this manner, it is possible to output a clear picture image without any void even on the recording paper of a low superficial smoothness. Further, since substantially the whole amount of the thermoplastic ink image 21 on the second intermediate transfer medium 14 can be transferred to the recording paper 12, it is possible to dispense with any cleaning means which is otherwise required for cleaning the ink remaining on the surface of the second intermediate transfer medium 14.

Next, operations for producing a mixed picture image combining the sublimable dyestuff image with the thermoplastic ink image will be described by referring to FIG. 5 and FIG. 6.

Figure 5:
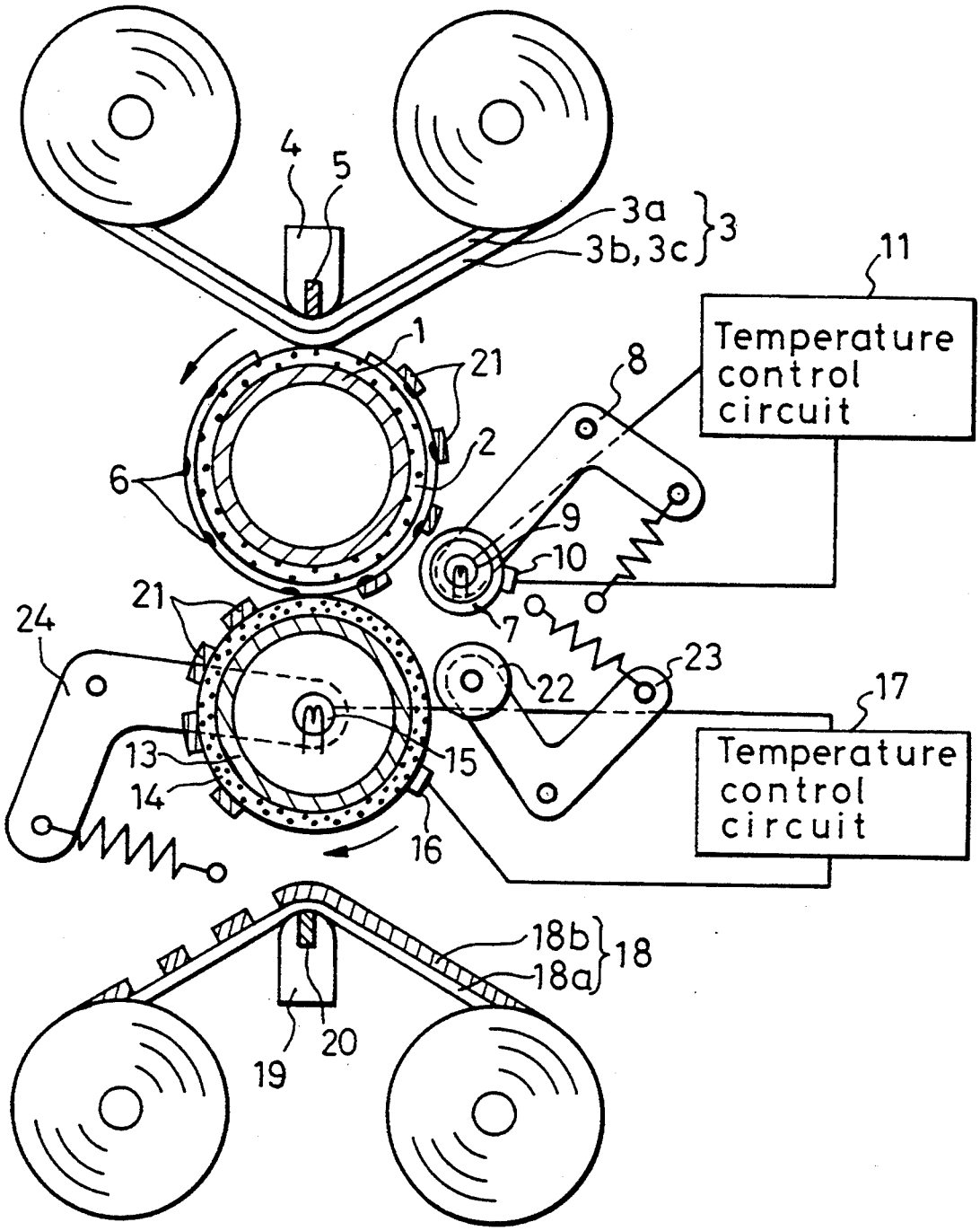
FIG. 5 illustrates a sectional view of a thermal transfer recording apparatus in the first embodiment for indicating an operation of producing a mixed image composed of an image with a thermoplastic ink and another image with a sublimable dye.
Figure 6:
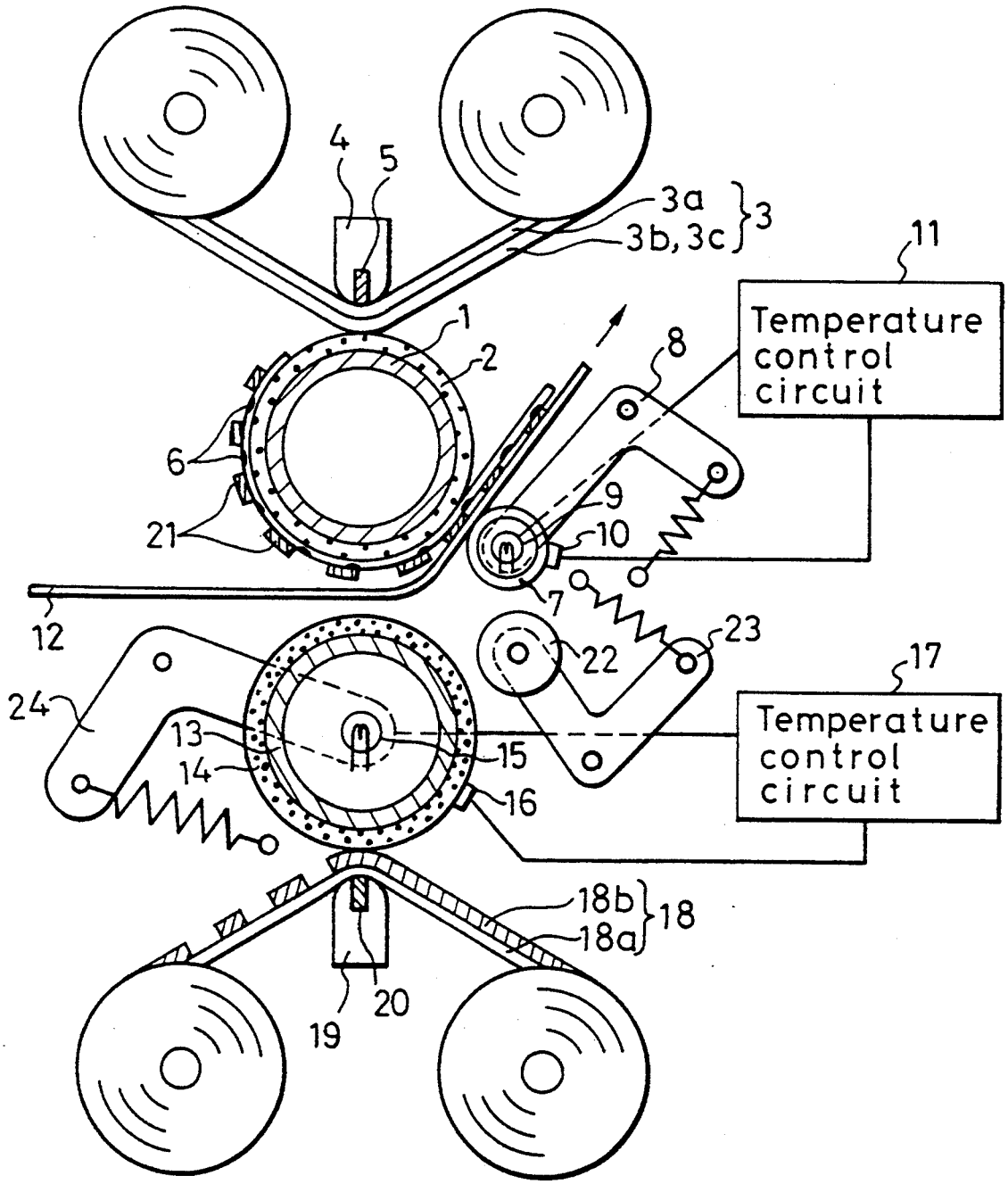
FIG. 6 illustrates a sectional view of a thermal transfer recording apparatus in the first embodiment for indicating an operation of transferring the produced mixed image composed of an image with a thermoplastic ink and another image with a sublimable dye on a recording paper.

In FIG. 5, the operations up to the production of the dyeable layer 3*b* on the first intermediate transfer medium 2 and the production of the sublimable dyestuff image 6 on the dyeable layer 3*b* are the same as the above-mentioned operation performed at the time of outputting the sublimable dyestuff image. Further, the operation for producing the thermoplastic ink image 21 on the second intermediate transfer medium 14 is the same as the above-mentioned operation performed at the time of producing the thermoplastic ink image 21.

At the time of recording the mixed picture image, the peripheral speed of the first intermediate transfer drum 1 is first switched to 50 mm/sec. In this state, the second intermediate transfer medium 14 which carries the thermoplastic ink image 21 is pressed against the first intermediate transfer medium 2 which carries the sublimable dyestuff image 6 by the pivoting movement of the lever 24. At that time, the second intermediate transfer medium 14 is heated to a temperature at which the thermoplastic ink image 21 generates an adhesive force and kept at the temperature. In this manner, it is possible to transfer the thermoplastic ink image 21 to the dyeable layer 2*b* on which the sublimable dyestuff image 6 has previously been formed.

Next, an operation for transferring the dyeable layer 3*b*, on which both the sublimable dyestuff image 6 and the thermoplastic ink image 21 are recorded, to the recording paper 12 will be described by referring to FIG. 6. First, the peripheral speed of the first intermediate transfer drum 1 is switched to 10 mm/sec. In this state, by pressing the pressure roller 7 against the first intermediate transfer medium 2 through the recording paper 12, it is possible to transfer the dyeable layer 3*b*, on which both the sublimable dyestuff image 6 and the thermoplastic ink image 21 are recorded, to the recording paper 12. In this manner, it is possible to record the mixed picture image, which combines the full-colored picture image of the sublimable dyestuffs with the thermoplastic ink image, on a plain paper not to mention of the exclusive-use paper, in a high production quality.

In this embodiment, the foregoing description of producing the mixed picture image, which combines the sublimable dyestuff image with the thermoplastic ink image, has been primarily directed to that of pressing the second intermediate transfer medium 14 which carries the thermoplastic ink image 21 against the first intermediate transfer medium 2, thereby transferring the thermoplastic ink image 21 to the dyeable layer 3*b*. It is however also possible to conversely press the first intermediate transfer medium 2 against the second intermediate transfer medium 14 which carries the thermoplastic ink image 21, thereby transferring the thermoplastic ink image 21 to the dyeable layer 3*b*.

Further, although the peripheral speed of the first intermediate transfer drum 1 is switched at the time of transferring the thermoplastic ink image 21 to the dyeable layer 3*b* in this embodiment, it is also possible to obtain the same result by switching the peripheral speed of the second intermediate transfer drum 13. Moreover, an optimum peripheral speed of the first intermediate transfer medium 2 might be different depending on the steps of forming the dyeable layer 3*b* on the first intermediate transfer medium 2 and of thermally recording the sublimable dyestuff image 6 on the formed dyeable layer 3*b*. An optimum peripheral speed of the first intermediate transfer drum 1 might also be different depending on the steps of forming the sublimable dyestuff image 6 on the dyeable layer 3*b* produced on the first intermediate transfer medium 2 and of transferring the thermoplastic ink image 21 carried on the second intermediate transfer medium 14 to the dyeable layer 3*b* formed on the first intermediate transfer medium 2. For these cases, it is possible to drive the first intermediate transfer drum always at its optimum peripheral speed and to obtain a picture image of high production quality in a stable operation, because the apparatus of this embodiment is provided with a means for switching the peripheral speed of the first intermediate transfer drum 1.

Moreover, at the time of outputting the thermoplastic ink image 21, the transferring operation of the thermoplastic ink image 21 to the recording paper 12 begins only after the formation of the thermoplastic ink image 21 on the second intermediate transfer medium 14 has previously been completed in this embodiment. However, the transferring operation of the thermoplastic ink image 21 to the recording paper 12 may alternatively be performed, while the thermoplastic ink image 21 is being formed on the second intermediate transfer medium 14. By performing the operation in this manner, it is possible to accelerate the outputting operation of the thermoplastic ink image 21 on the recording paper 12, and to make the length of the outer periphery of the second intermediate transfer drum 13 shorter than the length of the outputting picture image. In other words, it is possible to make the diameter of the second intermediate transfer drum 13 small and to realize a miniaturalization of the apparatus.

Further, the outputting operation of the mixed picture image, which combines the sublimable dyestuff image with the thermoplastic ink image, can simultaneously be performed with the outputting operation of the thermoplastic ink image. That is, while the thermoplastic ink image 21 is being formed on the second intermediate transfer medium 14, the thermally-soluble ink image 21 can be transferred to the dyeable layer 3*b* formed on the first intermediate transfer medium 2. In this case, it is needless to say that the second recording means 19, the thermoplastic ink sheet 18 and the like are required to be pressed against the first intermediate transfer medium 2, not to mention of the second intermediate transfer drum 13.

As has previously been described, a high resolution full-colored picture image with the sublimable dyestuff can be obtained by the above-mentioned outputting operation of the sublimable dyestuff picture image. Further, a thermoplastic ink picture image on the recording paper of low surface smoothness with a high production quality can be obtained by the above-mentioned outputting operation of thermoplastic ink image. Moreover, a mixed picture image of a high resolution full-colored picture image with the sublimable dyestuff and a thermoplastic ink picture image of a high production quality can simultaneously be obtained by the above-mentioned outputting operation of the mixed picture image, which combines the sublimable dyestuff picture image with the thermoplastic ink picture image.

Therefore, by arbitrarily selecting any of the above-mentioned three operations, it is possible to obtain either one of (1) the high resolution full-colored picture image with the sublimable dyestuff, the (2) thermoplastic ink picture image on the recording paper of the low superficial smoothness with the high production quality, and (3) the mixed picture image wherein the high resolution full-colored picture image with the sublimable dyestuff and the thermoplastic ink picture image of the high production quality are present, in a single unit of the apparatus at the operator's will.

In this embodiment, although the first intermediate transfer drum 1 and the second intermediate transfer drum 13 are employed for supporting the media, they can preferably be substituted with belt-like base or substrate members on which the first intermediate transfer medium 2 and the second intermediate transfer medium 14 are respectively formed.

In this embodiment, although no heating or warmth-keeping means is provided on the pressing roller 22, it is effective for the pressing roller 22 to provide such a means. By this provision, it is possible to make the transferring of the thermoplastic ink image 21, which has been previously formed on the second intermediate transfer medium 2, to the recording paper 12 in a more stable manner.

In this embodiment, although the sublimable ink sheet 3, on which both the dyeable layer 3*b* and the dyestuff layers 3*c*, each designated by Y, M and C are sequentially and lengthwisely formed, is employed, it may preferably be substituted by a separate sheet on which only the dyeable layer 3*b* is formed and another sheet on which the dyestuff layers, each designated by Y, M and C are sequentially formed. The last-mentioned sheet may further be substituted by separate sheets carrying the individual dyestuff layers, each designated by Y, M and C.

Second Embodiment

Figure 7:
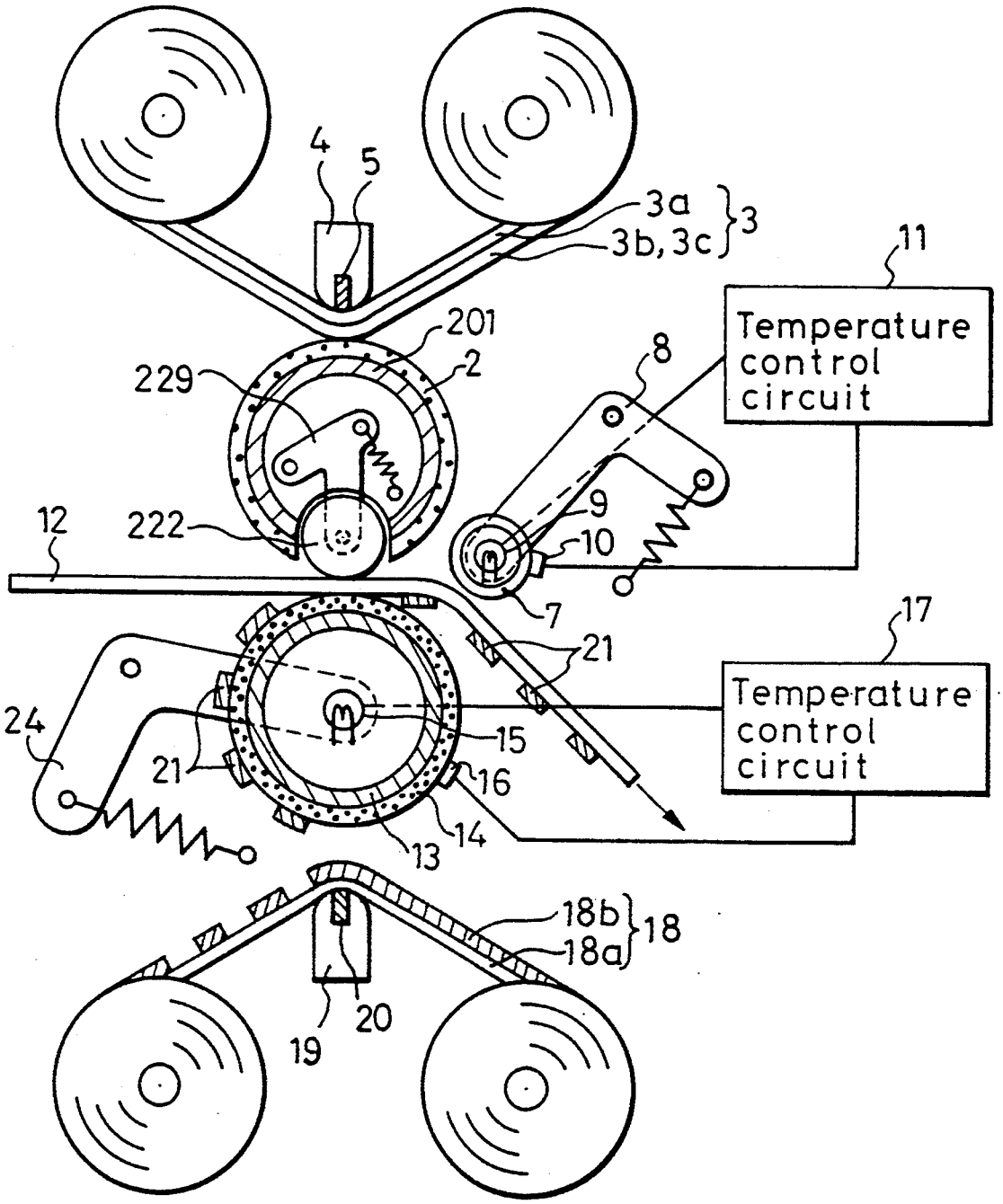
FIG. 7 illustrates a sectional view of a thermal transfer recording apparatus reflecting a second embodiment of the invention.

In the following paragraphs, the second embodiment of the recording apparatus built in accordance with the present invention will be described by referring to FIG. 7. In FIG. 7 and subsequent figures, parts and components having identical or analogous functions to those in the apparatus of the foregoing embodiment are designated by the same or related reference symbols.

Different from the first embodiment shown in FIG. 1, the recording apparatus shown in FIG. 7 is provided with a second transferring means composed of a pressure roller 222 and a lever 229 in a manner that the second transferring means is enclosed in a first intermediate transfer drum 201 having the shown peculiar shape. That is, the pressure roller 222 is positioned at a cut-out part provided on the first intermediate transfer drum 201 so that its axis is in parallel with that of the first intermediate transfer drum 201. In that position, the pressure roller 222 is rotatably supported by the lever 229 in a manner that it can press itself against a second intermediate transfer medium 214 through the cut-out part at a desired timing. The lever 229 has a configuration different from the lever 8 shown in FIG. 1.

Next, operations of the above-mentioned apparatus will be described. In this embodiment, the operations for recording the sublimable dyestuff image, and those for recording the mixed picture image which combines the sublimable dyestuff image with the thermoplastic ink image are totally similar to those in the first embodiment. During the operation for recording the thermoplastic ink image, the formation of the thermoplastic ink image 21 on the second intermediate transfer medium 14 is similar to that in the first embodiment. An operation for transferring the thermoplastic ink image 21 formed on the second intermediate transfer medium 14 to the recording paper 12 is however different from that in the first embodiment. Namely, during the transferring operation of the thermoplastic ink image 21 to the recording paper 12, the first intermediate transfer drum 201 stands still at a position indicated by FIG. 7. In that state, the recording paper 12 is forwarded in the direction of an arrow in this figure by a suitable paper-transferring means (not shown), and the pressure roller 222 is pressed against the second intermediate transfer medium 14 through the recording paper 12. In this manner, the thermoplastic ink image 21 on the second intermediate transfer medium 14 is transferred to the recording paper 12.

By the above-mentioned provision of the pressure roller 222 enclosed in the first intermediate transfer drum 201, it is possible to realize a miniaturization of the apparatus. Further, the running path of the recording paper 12 can be simplified during the respective operations for transferring the sublimable dyestuff image on the recording paper 12, for transferring the thermoplastic ink image, and for transferring the mixed picture image which combines the sublimable dyestuff image with the thermoplastic ink image in this embodiment. It is thus possible to configure a stable apparatus which is substantially free from a trouble such as paper clogging.

Further, although the pressure roller 222 is pressed against the second intermediate transfer medium 14 in this embodiment, it is also possible to configure the apparatus in a manner that the second intermediate transfer medium 14 is caused to be pressed against the first intermediate transfer medium 202. In this case, since the same operations can be applied to both of (1) transferring the thermoplastic ink image formed on the second intermediate transfer medium 14 to the dyeable layer **3*b* formed on the first intermediate transfer medium 2, and of (2) transferring the thermoplastic ink image 21 to the recording paper 12**, it is possible to realize a simplification of the apparatus configuration.

Third Embodiment

In the following paragraphs, the third embodiment of the recording apparatus built in accordance with the present invention will be described by referring to FIG. 8.

Figure 8:
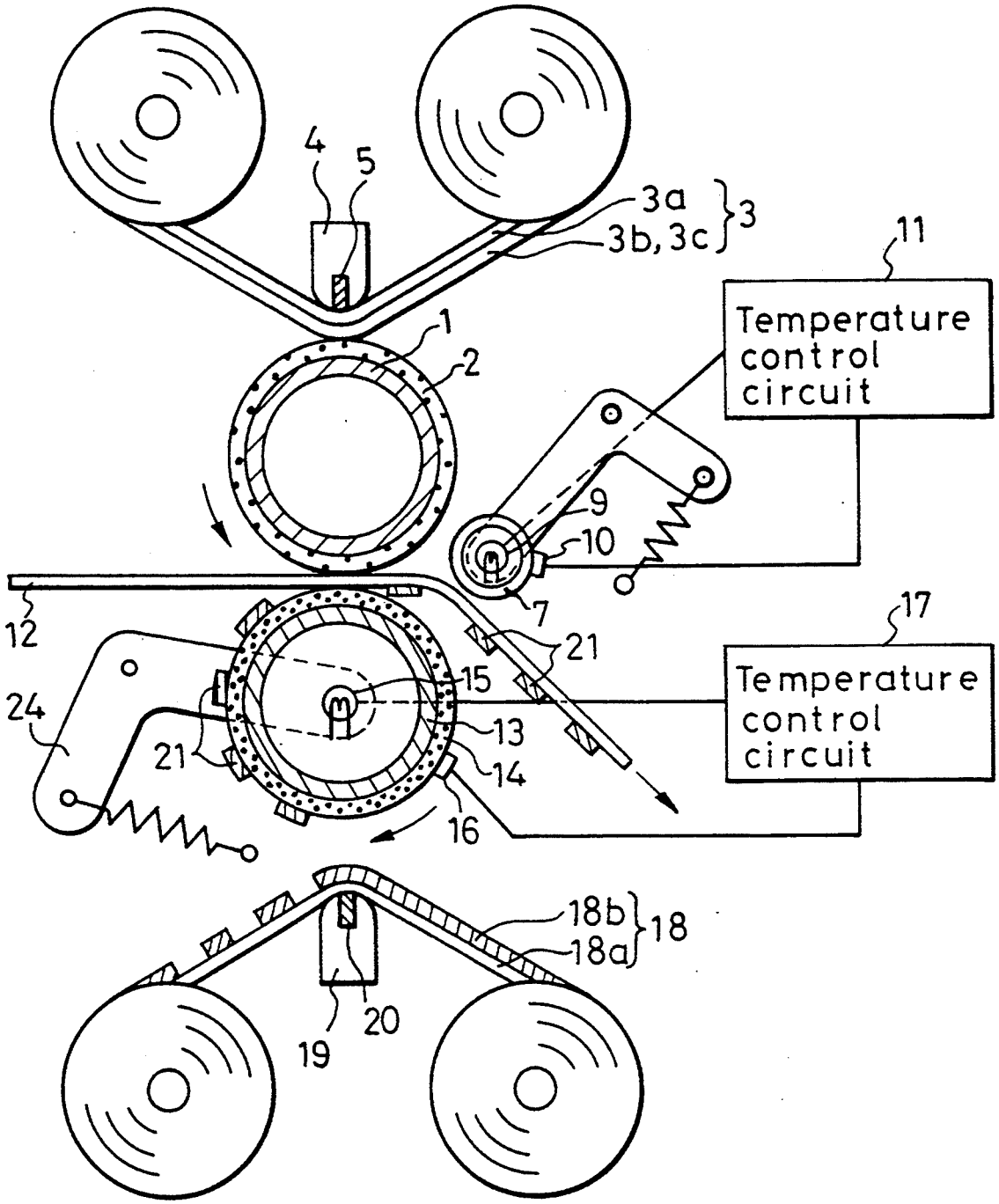
FIG. 8 illustrates a sectional view of a thermal transfer recording apparatus reflecting a third embodiment of the invention.

Different from the first embodiment shown in FIG. 1, the recording apparatus shown in FIG. 8 dispenses with the second transferring means composed of the pressure roller 22 and the lever 23 in FIG. 1. The recording apparatus shown in FIG. 8 employs the first intermediate transfer drum 1 also as the second transferring means.

Next, operations of the above-mentioned apparatus will be described. In this embodiment shown in FIG. 8, the operations for recording the sublimable dyestuff image, and those for recording the mixed picture image which combines the sublimable dyestuff image with the thermoplastic ink image are totally similar to those in the first embodiment. During the operation for recording the thermoplastic ink image, the formation of the thermoplastic ink image 21 on the second intermediate transfer medium 14 is similar to that in the first embodiment. An operation for transferring the thermoplastic ink image 21 to the recording paper 12 is however different from that in the first embodiment. Namely, although the pressure roller 22 shown in FIG. 1 is employed in the first embodiment during the transferring operation of the thermoplastic ink image 21 to the recording paper 12, the first intermediate transfer drum 1 of this embodiment is caused to also serve as the pressure roller 22 of FIG. 1. During the transferring operation of the thermoplastic ink image 21 formed on the second intermediate transfer medium 14 to the recording paper 12, the second intermediate transfer drum 13 is moved to a position shown in FIG. 8, and presses the second intermediate transfer medium 14 against the first intermediate transfer medium 2. In this manner, it is possible to transfer the thermoplastic ink image 21 formed on the second intermediate transfer medium 14 to the recording paper 12. It is therefore possible to realize a simplification of the apparatus configuration because the second transferring means can be dispensed with in this configuration.

Further, the second intermediate transfer medium 14 is pressed against the first intermediate transfer medium 2 through the recording paper 12 during the operation for transferring the thermoplastic ink image 21 on the second intermediate transfer medium 14 to the recording paper 12 in this embodiment. It is however also possible to configure the apparatus in a manner that the first intermediate transfer medium 2 is conversely caused to be pressed against the second intermediate transfer medium 14. In this case however, the first intermediate transfer drum 1 is required to be provided with a suitable mechanism for touching to or separating from the second intermediate transfer medium 14.

Fourth Embodiment

In the following paragraphs, the fourth embodiment of the recording apparatus built in accordance with the present invention will be described by referring to FIG. 9 and FIG. 10.

Figure 9:
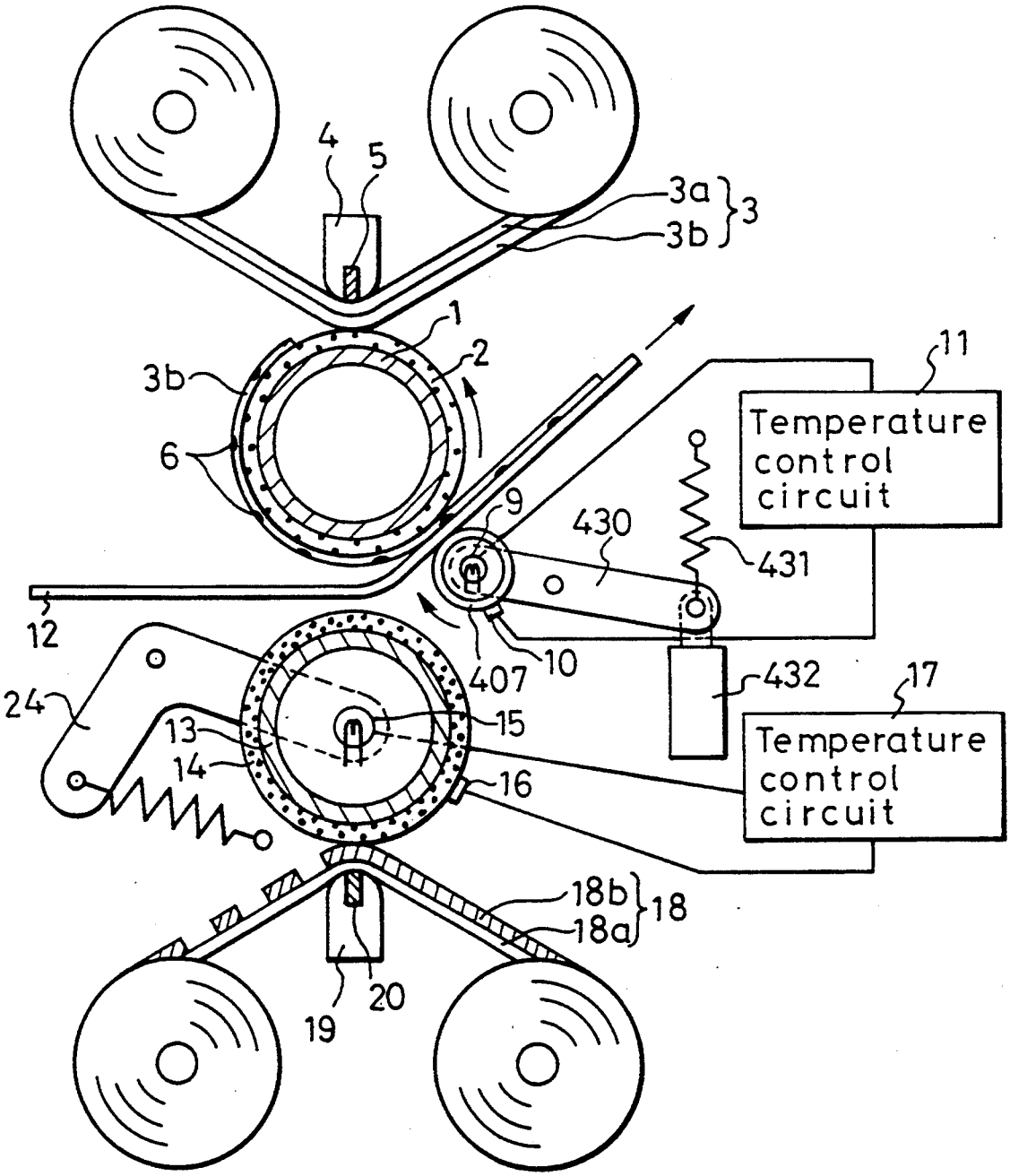
FIG. 9 illustrates a sectional view of a thermal transfer recording apparatus reflecting a fourth embodiment of the invention and indicating an operation of transferring a produced dyeable layer to a recording paper.

Different from the first embodiment shown in FIG. 1, the recording apparatus shown in FIG. 9 employs the first transferring means also as a second transferring means. In other words, the Second transferring means composed of the pressure roller 22 and the lever 29 in the first embodiment is dispensed with in this embodiment. Instead, the apparatus of this embodiment employs a pressure roller 407 and a lever 430 also as the first transferring means. The lever 430 takes a configuration different from the lever 8 shown in FIG. 1. The lever 430 is pivotably supported on a stationary part of the apparatus and is provided with a spring 431 and a solenoid 432. By being configured as this, it is possible for the pressure roller 407 to press itself against either the first intermediate transfer medium 2 or the second intermediate transfer medium 14. Another difference from the first embodiment resides in a configuration that the warmth-keeping temperature of the pressure roller 407 by a heating or warmth-keeping means 9 can be switched in response to the process of the recording operation.

Next, operations of the above-mentioned apparatus will be described. In this embodiment, the respective operations for forming the sublimable dyestuff image 6, those for forming the thermoplastic ink image 21, and those for forming the mixed picture image which combines the sublimable dyestuff image 6 with the thermoplastic ink image 21 are totally similar to those in the first embodiment. Point of difference resides in an operation for transferring the image formed on the first intermediate transfer medium 2 or the image formed on the second intermediate transfer medium 14 to the recording paper 12.

First, a description will be made on an operation for transferring the sublimable dyestuff image 6, or the mixed picture image which combines the sublimable dyestuff image 6 with the thermoplastic ink image 21 formed on the first intermediate transfer medium 2 to the recording paper 12. During the operation, the solenoid 432 is electrified so that the lever 430 rotates in the clockwise direction in this figure for causing the pressure roller 407 to come into a position shown in FIG. 9. In this state, the recording paper 12 is forwarded so that the pressure roller 407 is caused to press against the first intermediate transfer medium 2 through this recording paper 12. By this procedure, it is possible to transfer the sublimable dyestuff image 6, or the mixed picture image which combines the sublimable dyestuff image 6 and the thermoplastic ink image 21 formed on the first intermediate transfer medium 2 to the recording paper 12.

Next, a description will be made on an operation for transferring the thermoplastic ink image 21 formed on the second intermediate transfer medium 14 to the recording paper 12 by referring to FIG. 10.

Figure 10:
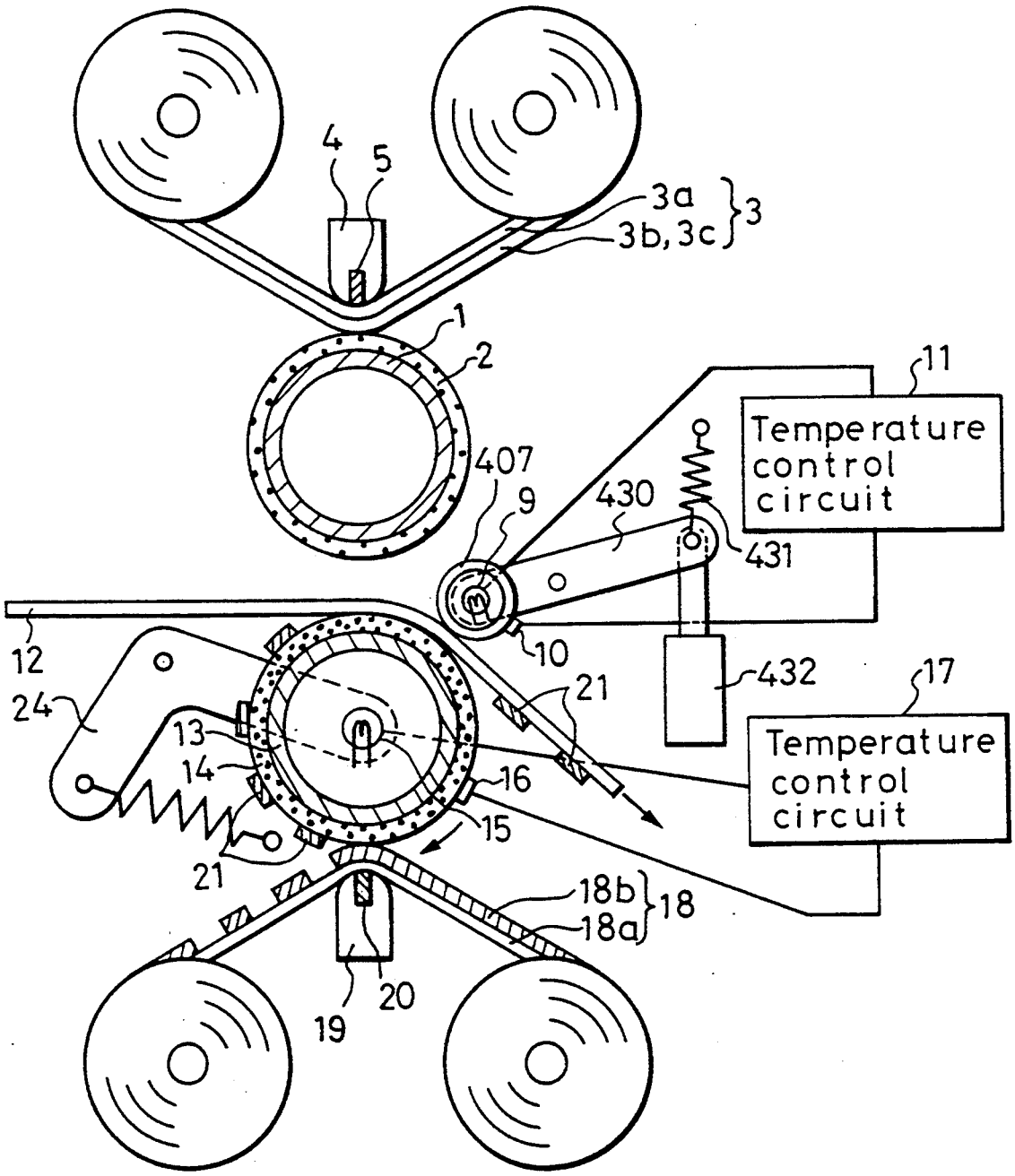
FIG. 10 illustrates a sectional view of a thermal transfer recording apparatus of the fourth embodiment indicating an operation of transferring a produced thermoplastic ink image to a recording paper.

During the operation, the electrification to the solenoid 432 is stopped so that the lever 430 rotates in the anti-clockwise direction by a resiliency of the spring 431 for causing the pressure roller 407 to come into a position shown in FIG. 10. In this state, the recording paper 12 is forwarded so that the pressure roller 407 is caused to press against the second intermediate transfer medium 14 through this recording paper 12. By this procedure, it is possible to transfer the thermoplastic ink image 21 formed on the second intermediate transfer medium 14 to the recording paper 12.

As being configured as above-mentioned manner, wherein the first transferring means is caused to also serve as the second transferring means shown in FIG. 1, it is possible to dispense with the second transferring means, and thus to provide a small size apparatus of simple configuration.

Next, a description will be made on the case wherein the warmth-keeping temperature of the pressure roller 407 by the heating and warmth-keeping means 409 is switched in response to the process of the recording operation.

There is a difference in an optimum warmth-keeping temperature of the pressure roller 407, between a case of thermally transferring the dyeable layer **3*b* formed on the first intermediate transfer medium 2 to the recording paper 12, and a case of transferring the thermoplastic ink image 21 formed on the second intermediate transfer medium 14 to the recording paper 12. The warmth-keeping temperature of the pressure roller 407 in this embodiment is preferably in a range between 100° C. and 200° C. for transferring the sublimable dyestuff image 6 formed on the first intermediate transfer medium 2 to the recording paper 12. However, the warmth-keeping temperature of the pressure roller 407 is preferably in a range between 0° C. and 120° C. for transferring the thermoplastic ink image 21 formed on the second intermediate transfer medium 14 to the recording paper 12. Therefore, the permissible warmth-keeping temperature of the pressure roller 407** is preferably in a range between 100° C. and 120° C. As far as a strict control on this temperature is performed and the condition of the process stipulated in the first embodiment is carefully observed, no trouble could result therefrom.

However, by switching the warmth-keeping temperature of the pressure roller 407 for always maintaining it to the optimum value as in this embodiment, it is possible to widen a latitude in selecting the dyeable layer **3*b*, the thermoplastic ink 18*b* and the like. It is also possible to transfer the sublimable dyestuff image 6 and the thermoplastic ink image 21 to the recording paper 12** in a stable operation, even in a case of changes in the ambient temperature and the like.

Fifth Embodiment

In the following paragraphs, the fifth embodiment of the recording apparatus built in accordance with the present invention will be described by referring to FIG. 11.

Figure 11:
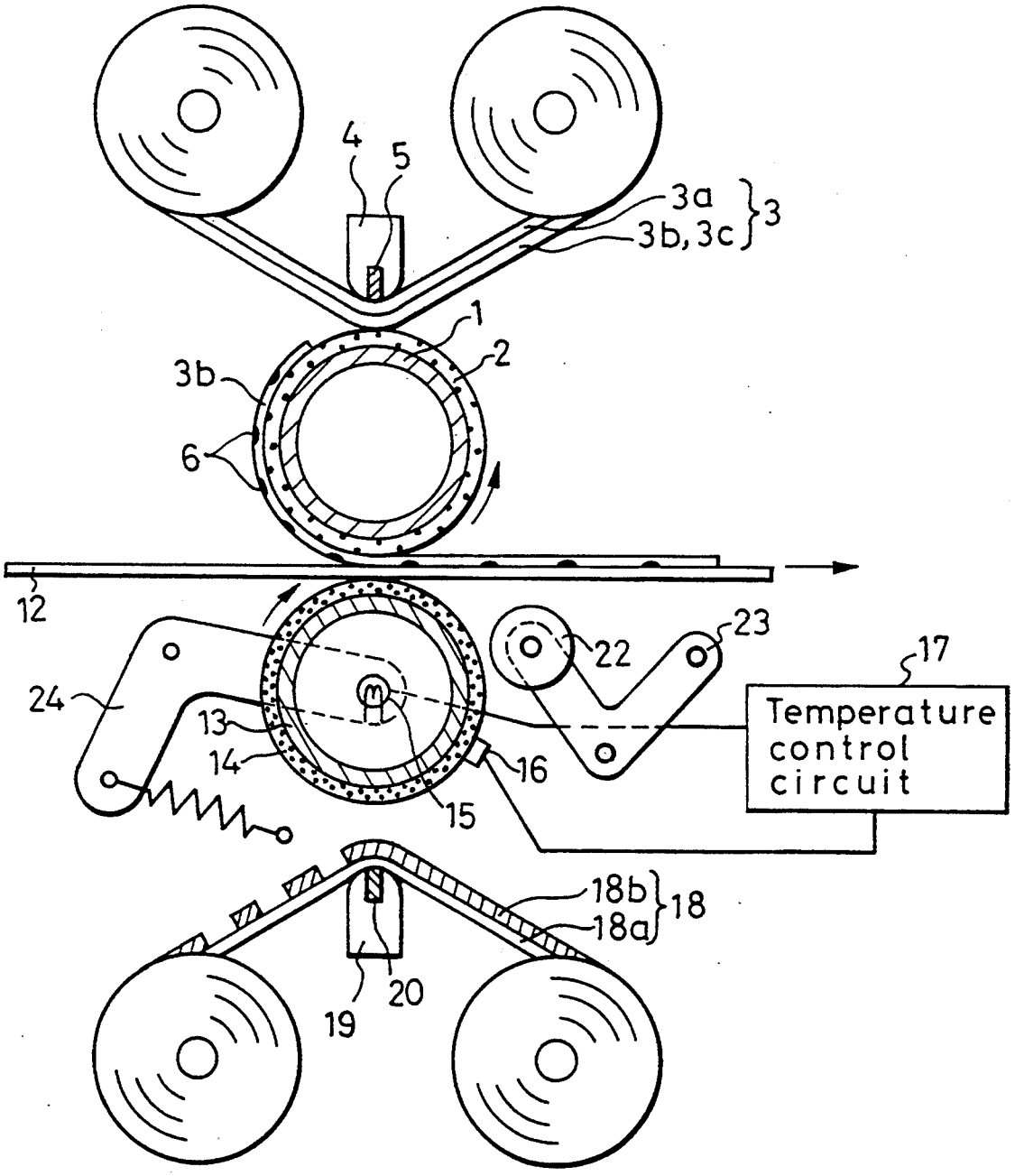
FIG. 11 illustrates a sectional view of a thermal transfer recording apparatus reflecting a fifth embodiment of the invention.

Different from the first embodiment shown in FIG. 1, the recording apparatus shown in FIG. 11 dispenses with the first transferring means in FIG. 1 and employs the second intermediate transfer drum 13 also as the first transferring means. Another difference from the first embodiment resides in a configuration that the warmth-keeping temperature of the second intermediate transfer medium 14 by a heating or warmth-keeping means 15 can be switched in response to the process of the recording operation.

Next, operations of the above-mentioned apparatus will be described. In this embodiment, the operations different from the first embodiment are (1) that for thermally transferring the dyeable layer **3*b* carrying the sublimable dyestuff image 6 formed on the first intermediate transfer medium 2 to the recording paper 12, and (2) that for transferring the dyeable layer 3*b* carrying both the sublimable dyestuff image 6 and the thermoplastic ink image 21 formed on the first intermediate transfer medium 2 to the recording paper 12. The pressure roller 7 has been pressed against the first intermediate transfer medium 2 through the recording paper 12 during these operations in the embodiment of FIG. 1. In this embodiment however, the second intermediate transfer drum 13 is pressed against the first intermediate transfer medium 2 through the recording paper 12, thereby transferring the sublimable dyestuff image 6 or the mixed picture image which combines the sublimable dyestuff image 6 and the thermoplastic ink image 21 to the recording paper 12. Thus, the first transferring means in FIG. 1** can be dispensed with and it is possible to realize a simplification of the apparatus configuration.

Next, a description will be made on the case wherein the warmth-keeping temperature of the second intermediate transfer medium 14 by the heating and warmth-keeping means 15 is switched in response to the process of the recording operation.

There is a difference in an optimum warmth-keeping temperature of the second intermediate transfer medium 14, between a case of thermally transferring the dyeable layer 3*b* formed on the first intermediate transfer medium 2 to the recording paper 12, and a case of transferring the thermoplastic ink image 21 formed on the second intermediate transfer medium 14 to the recording paper 12. Provided that the conditions for the recording process are the same as those in the first embodiment, the warmth-keeping temperature of the second intermediate transfer medium 14 in this embodiment is preferably in a range between 100° C. and 200° C. for transferring the dyeable layer 3*b* formed on the first intermediate transfer medium 2 to the recording paper 12. However, the warmth-keeping temperature of the second intermediate transfer medium 14 is preferably in a range between 55° C. and 110° C. for transferring the thermoplastic ink image 21 formed on the second intermediate transfer medium 14 to the recording paper 12. Therefore, the permissible warmth-keeping temperature for the second intermediate transfer medium 14 is preferably in a range between 100° C. and 120° C. As far as a strict control to this temperature is performed in the apparatus and the condition of the process stipulated in the first embodiment is carefully observed, no trouble could result therefrom.

In this embodiment however, the warmth-keeping temperature of the second intermediate transfer medium 14 can always be maintained it to its optimum value, by switching this temperature, depending upon the cases of transferring the dyeable layer 3*b* formed on the first intermediate transfer medium 2 to the recording paper 12, and of transferring the thermoplastic ink image 21 formed on the second intermediate transfer medium 14 to the recording paper 12.

In addition to this, it is possible to widen a latitude in selecting the dyeable layer 3*b*, the thermoplastic ink 18*b* and the like, by switching the warmth-keeping temperature of the second intermediate transfer medium 14. It is also possible to transfer the sublimable dyestuff image 6 and the thermoplastic ink image 21 to the recording paper 12 in a stable operation, even in a case of changes in the ambient temperature and the like.

In this embodiment, the second intermediate transfer medium 14 is pressed against the first intermediate transfer medium 2 during the operation for transferring the dyeable layer 3*b* which carries the sublimable dyestuff image 6 or both the sublimable dyestuff image 6 as well as the thermoplastic ink image 21, formed on the first intermediate transfer medium 2 to the recording paper 12. It is also possible to configure the apparatus in a manner that the first intermediate transfer medium 2 is caused to press against the second intermediate transfer medium 14 through the recording paper 12.

Moreover, although the second transferring means is employed in this embodiment, the second transferring means may be dispensed with by employing the first intermediate transfer drum also as a second transferring means.

Although the present invention has been described in terms of the presently preferred embodiments, it is to be understood that such disclosures is not to be interpreted as limiting. Various alterations and modifications will no doubt become apparent to those skilled in the art to which the present invention pertains, after having read the above disclosure. Accordingly, it is intended that the appended claims be interpreted as covering all alterations and modifications as fall within the true spirit and scope of the invention.

What is claimed is:

1. A thermal transfer recording apparatus comprising, a first intermediate transfer medium;

a dyeable layer-carrying sheet having a dyeable layer;

a sublimable dyestuff-carrying sheet, having a plurality of sublimable dyestuff layer-carrying sections, each containing a sublimable dyestuff layer;

a dyeable layer-forming means for transferring said dyeable layer on said dyeable layer-carrying sheet, to said first intermediate transfer medium;

a first recording means for forming a sublimable dyestuff image on said dyeable layer on said first intermediate transfer medium, by selectively heating the sublimable dyestuffs contained in said sublimable dyestuff-carrying sheet;

a first transferring means for thermally transferring said dyeable layer formed on said first intermediate transfer medium to a recording paper;

a second intermediate transfer medium;

a thermoplastic ink-carrying sheet having a layer of the thermoplastic ink;

a second recording means for forming a thermoplastic ink image on said second intermediate transfer medium, by selectively heating the thermoplastic ink contained in said thermoplastic ink-carrying sheet;

a second transferring means for thermally transferring said thermoplastic ink image formed on said second intermediate transfer medium to a recording paper; and a third transferring means for thermally transferring said thermoplastic ink image formed on said second intermediate transfer medium to said dyeable layer formed on said first intermediate transfer medium.

2. The thermal transfer recording apparatus in accordance with claim 1, wherein said first and second intermediate transfer media each is a hollow cylindrical layer made of silicone rubber or elastomer and supported on a drum made of metal.

3. The thermal transfer recording apparatus in accordance with claim 2, wherein said silicone rubber or elastomer has a certain mold-releasing or parting property and an adhesivity which may differ from each other for the first and the second intermediate transfer media.

4. The thermal transfer recording apparatus in accordance with claim 1, wherein said dyeable layer-forming means also serves as said first recording means, and comprises a sheet transfer means for sequentially transferring said dyeable layer-carrying sheet and said sublimable dyestuff-carrying sheet along a predetermined passage which includes a contact position at which said sheets come into contact with said first intermediate transfer medium and a separating position at which said sheets are bent in a direction to be forcefully separated from said first intermediate transfer medium, and a thermal head for selectively heating said dyeable layer-carrying sheet and said sublimable dyestuff-carrying sheet brought into contact with said first intermediate transfer medium at said contact position so that said dyeable layer selectively adheres to said first intermediate transfer medium, and then said sublimable dyestuff selectively diffuses into said dyeable layer which has been adhered to the first intermediate transfer medium to form a sublimable dyestuff image thereon.

5. The thermal transfer recording apparatus in accordance with claim 1, wherein said first transferring means comprises a pressure roller rotatably mounted on a lever which resiliently presses said recording paper against the first intermediate transfer medium through said dyeable layer, and a heating or warmth-keeping means for heating said pressure roller to a target temperature and for keeping this temperature, at which said transferring is sufficiently performed.

6. The thermal transfer recording apparatus in accordance with claim 5, wherein said heating or warmth-keeping means is a halogen lamp combined with a temperature control circuit for performing an on/off control of said halogen lamp in response to a signal from a thermistor disposed in the vicinity of the surface of said pressure roller.

7. The thermal transfer recording apparatus in accordance with claim 1, wherein said second recording means comprises an ink sheet transfer means for sequentially transferring said thermoplastic ink-carrying sheet along a predetermined passage which includes a contact position at which said sheet comes into contact with said second intermediate transfer medium and a separating position at which said sheet is bent in a direction to be forcefully separated from said second intermediate transfer medium, and a thermal head for selectively heating said thermoplastic ink-carrying sheet brought into contact with said first intermediate transfer medium at said contact position so that said thermoplastic ink selectively adheres to said second intermediate transfer medium.

8. The thermal transfer recording apparatus in accordance with claim 1, wherein said second transferring means comprises a pressure roller rotatably mounted on a lever which resiliently presses said recording paper against the second intermediate transfer medium, for effecting said transferring of said thermoplastic ink image to the recording paper.

9. The thermal transfer recording apparatus in accordance with claim 1, wherein said first recording means also serves as said dyeable layer-forming means; and said sublimable dyestuff-carrying sheet, comprises a base or substrate film on which said dyeable layer section and a plurality of sublimable dyestuff layers sections are sequentially painted in combination in the lengthwise direction for every unit.

10. The thermal transfer recording apparatus in accordance with claim 1, wherein said third transferring means comprises a heating or warmth-keeping means for heating said second intermediate transfer medium to a target temperature and for keeping this temperature, a lever which rotatably mounts a drum for supporting said second intermediate transfer medium, for resiliently presses said second intermediate transfer medium against said first intermediate transfer medium through said dyeable layer formed on said first intermediate transfer medium.

11. The thermal transfer recording apparatus in accordance with claim 10, wherein said heating or warmth-keeping means is a halogen lamp combined with a temperature control circuit for performing an on/off control of said halogen lamp in response to a signal from a thermistor disposed in the vicinity of the surface of said second intermediate transfer medium.

12. The thermal transfer recording apparatus in accordance with claim 1, further comprising a driving means for driving said first intermediate transfer medium at a variable running speed.

13. The thermal transfer recording apparatus in accordance with claim 1, wherein an image forming surface of said second intermediate transfer medium is made of a silicone rubber or elastomer.

14. The thermal transfer recording apparatus in accordance with claim 1, wherein said first intermediate transfer medium is provided on a hollow drum-like base or substrate body with a cut-out part; and said second transferring means is configured in a roll-shape, and mounted on said drum-like base or substrate body, so that said roll-shape component of said means can press against said second intermediate transfer medium through said cut-out part.

15. The thermal transfer recording apparatus in accordance with claim 1, wherein said first intermediate transfer medium is provided on a drum-like base or substrate body and also serves as said second transferring means.

16. The thermal transfer recording apparatus in accordance with claim 1, wherein said first transferring means comprises a pressure roller provided with a means for heating and warmth-keeping said pressure roller to a target temperature; and said first transferring means also serves as said second transferring means.

17. The thermal transfer recording apparatus in accordance with claim 16, wherein said target temperature to which said first transferring means is heated and kept is made switchable.

18. The thermal transfer recording apparatus in accordance with claim 1, wherein said second intermediate transfer medium is a layer made of a flexible or elastic material and is provided on a roll-shape base or substrate body and serves as said first transferring means.

19. The thermal transfer recording apparatus in accordance with claim 18, wherein a target temperature to which said second intermediate transfer medium is heated and kept is made switchable.

* * * * *